United States Patent [19]

McNeely, Jr.

[11] Patent Number: 4,560,012

[45] Date of Patent: Dec. 24, 1985

[54] DRILL COLLAR STRUCTURE FOR USE IN DEVIATED WELL BORE DRILLING

[76] Inventor: Branch M. McNeely, Jr., 5313 Pine St., Bellaire, Tex. 77401

[21] Appl. No.: 658,896

[22] Filed: Oct. 9, 1984

Related U.S. Application Data

[63] Continuation-in-part of Ser. No. 622,523, Jun. 20, 1984, abandoned, which is a continuation-in-part of Ser. No. 479,257, Mar. 28, 1983, abandoned.

[51] Int. Cl.[4] ..... E21B 7/04

[52] U.S. Cl. ..... 175/61; 175/320; 285/47; 138/149; 464/18

[58] Field of Search ..... 175/61, 320, 242, 359, 175/367, DIG. 1; 285/47, 138; 138/149; 464/18

[56] References Cited

U.S. PATENT DOCUMENTS

| | | | |
|---|---|---|---|
| 1,731,171 | 10/1929 | Miller | 175/320 |
| 2,126,075 | 8/1938 | Wright | 175/320 |
| 2,814,462 | 11/1960 | De Jarnett | 175/320 |
| 2,958,512 | 11/1960 | Humphrey | 175/320 |
| 3,126,214 | 3/1964 | Wong et al. | 285/173 |
| 3,176,494 | 4/1965 | Cullen et al. | 138/46 X |
| 3,179,188 | 4/1965 | De Jarnett | 175/320 |
| 3,263,446 | 8/1966 | Wiggins, Jr. | 175/320 |
| 3,265,091 | 8/1966 | De Jarnett | 175/320 |
| 3,274,798 | 9/1966 | Wiggins, Jr. | 175/320 |
| 3,422,914 | 1/1969 | Pomeroy | 175/320 |
| 3,926,265 | 12/1975 | Boutoucos | 175/320 X |
| 3,935,632 | 2/1976 | Maxson | 138/149 X |

FOREIGN PATENT DOCUMENTS

| | | | |
|---|---|---|---|
| 825827 | 3/1981 | U.S.S.R. | 175/320 |

*Primary Examiner*—Stephen J. Novosad
*Assistant Examiner*—Thuy M. Bui
*Attorney, Agent, or Firm*—Jack W. Hayden

[57] ABSTRACT

A drill collar is formed by inner and outer tube means having an annular space extending longitudinally therebetween. Rigid filler material in the annular space forms, with the inner and outer tube means, a unitary elongated tubular structure. The rigid filler material precludes movement of the inner and outer tube means relative to each other. A longitudinal bore extends through the tubular structure.

10 Claims, 7 Drawing Figures

DRILL COLLAR STRUCTURE FOR USE IN DEVIATED WELL BORE DRILLING

CROSS REFERENCE TO RELATED APPLICATION

This application is a continuation-in-part of my prior copending application Ser. No. 622,523 filed June 20, 1984 now abandoned, which in turn is a continuation-in-part of my prior application Ser. No. 479,257 filed Mar. 28, 1983, now abandoned.

SUMMARY OF THE INVENTION

In drilling well bores, it is conventional practice at present to provide the lower portion of the drill column or drill string with a bottom hole assembly which includes a plurality of thick, heavy wall tubular members with a longitudinal bore therethrough called "drill collars". It has always been generally accepted that drill collars must provide maximum weight and stiffness to obtain what has been considered the necessary strength and desired results.

Thus, conventional drill collars presently employed in drilling deviated well bores, as well as drilling so called vertical well bores, have always been constructed to have the largest outside diameter that can be washed over or retrieved by conventional methods from the well bore, where necessary, and to also have the smallest inside diameter for the longitudinal bore which will pass conventional wireline equipment. Within these two parameters, drill collar sizes geenerally have always been, and are at the present time, selected as big, heavy and as stiff as possible.

Present practice employing such heavy, thick wall drill collars in drilling deviated well bores has heretofore limited the rate of change in hole angle in deviated well bores, i.e., the change in angle of the well bore from the vertical, to a maximum of about 3° per 100 feet of well bore. This limitation is imposed because of the limiting stress caused in the drill collars and pipe by their rotation at high angle changes in the deviated or crooked well bore. Although deviated well bores up to the horizontal have been achieved with ordinary drill collars, such cases are rare, of limited extent and generally involve use of highly specialized equipment and technology.

A primary object of the present invention is to provide a tubular member for use in a drill string which overcomes the foregoing limitations encountered using heavy, solid wall drill collars for drilling deviated well bores.

Another primary object of the present invention is to provide a drill collar which enables the rate of hole angle buildup in drilling deviated well bores to be substantially increased over that heretofore considered possible or practical.

A further object of the present invention is to provide a tubular structure for use in drilling a deviated well bore which includes longitudinally extending inner and outer tube means that are spaced circumferentially and longitudinally to form an annular space therebetween; rigid filler material fills the annular space to form with the inner and outer tube means a unitary, longitudinally extending tubular structure. The rigid filler material precludes relative movement between the inner and outer tube means, and the resulting lightweight tubular structure bends less than conventional heavy, thick wall drill collars under the same end loading conditions, thus achieving and maintaining a high hole angle, which, for all practical purposes, cannot be accomplished with heavy, solid wall drill collars.

Yet a further object of the present invention is to provide a buoyant or near buoyant drill collar construction to enable substantially horizontal well bores or shafts to be drilled.

Still a further object of the present invention is to provide a drill collar construction to reduce, if not substantially eliminate, the pendulum effect of drill collars in deviated well bores so that a high angle hole may be achieved, maintained and drilled.

Another object of the present invention is to provide a drill collar constructed and arranged so that it is buoyant, or approaching a buoyant condition, so that in a high angle deviated well bore it is less susceptible to flexure under end load conditions.

Other objects and advantages of the present invention will become more readily apparent from a consideration of the following description and drawings.

DESCRIPTION OF THE PREFERRED EMBODIMENT

Figure 5:
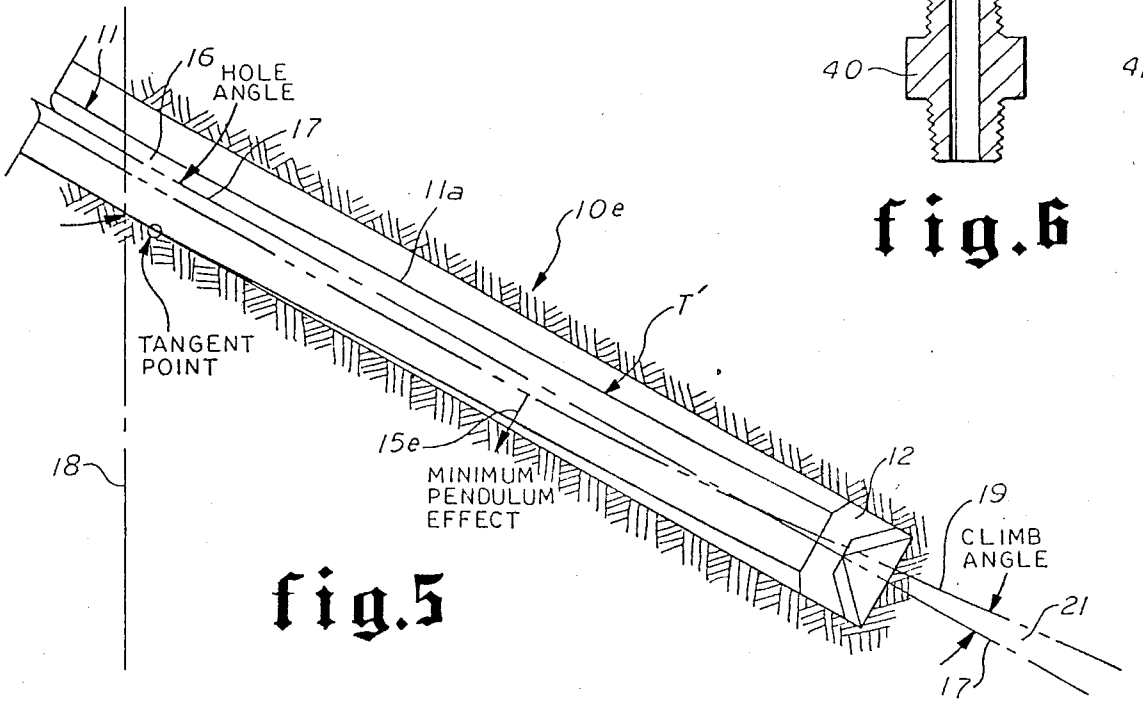
FIG. 5 is a sectional view illustrating a deviated well bore drilled with the present invention.
Figure 4:
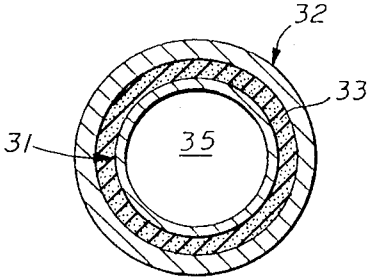
FIG. 4 is a transverse sectional view on the line 4—4 of FIG. 3.

Attention is first directed to FIG. 5 of the drawings wherein a slant hole or deviated well bore is illustrated generally by the numeral 10*e*. As will be understood by those skilled in the art, a drill string, referred to generally at 11, is formed of a plurality of longitudinally extending tubular members which extend to the earth's surface whereby rotation may be imparted to the drill string 11 and the drill bit 12 connected at the lower end thereof. The drill bit 12 is illustrated as being full gauge with the inner wall of the well bore 10*e*, i.e., the outer diameter of the drill bit 12 is shown as being substantially the same as the diameter of the well bore 10*e*. As noted previously, the portion of the drill string 11 extending from the drill bit 12 to a desired longitudinal extent thereabove in a so called vertical well bore consists of heavy, thick walled members normally termed drill collars. The drill collars are intended to apply weight to the drill bit in an endeavor to maintain the drill bit in as near vertical position as possible. Heretofore, these same drill collars have been used in deviated well bores, such as represented at 10*e* in FIG. 5.

The tangent point, i.e., the point at which the drill collars first contact the low side of the well bore 10*e*, is illustrated in FIG. 5. By means of the present invention, the pendulum effect acting on the drill bit 12 is decreased and kept at a minimum as compared with prior art devices. This pendulum effect is represented by the arrow designated 15*e* in FIG. 5. Where the distance between the tangent point, designated by the arrow and the term "target point" in FIG. 5, and the drill bit 12 is longer, the pendulum effect, or the effect of the drill collars 11*a* acting on the drill bit 12 tending to swing the drill bit back towards the vertical, represented by the line 18, is increased.

The climb angle, i.e., the angular relationship between the axis of the hole, represented by the dotted line 17, and the axis of the drill collars 11*a* in the drill string at the bottom of the well bore 10*e*, and represented by the dotted line 19, is indicated by the numeral 21.

High angle holes, such as those desired in deviated well bores, are more difficult not only to achieve, but to maintain during drilling operations than low angle holes since they tend to fall off (swing back towards the vertical) due to the pendulum effect of the heavy, stiff, thick wall drill collar construction presently employed.

In prior art bottom hole assemblies used for slant hole drilling, the largest diameter and heaviest drill collar that can be retrieved is selected to provide maximum stiffness. This selection also results in a drill collar of maximum weight and maximum pendulum effect. As hole angle increases, the pendulum effect imposed at the stabilizer used in prior art assemblies increases until the load carrying capability of the formation has been reached or stabilizer wear occurs. Under these conditions, maximum hole angle has been reached.

In a deviated well bore, the lower portion of the drill string is in contact with the well bore wall at the tangent point and at the bit or stabilizer. In between these two points it is unsupported. Due to its own weight, prior art drill collars sag or bow as with a beam of substantial weight and length. When end load is applied to apply weight to the bit, the tendency of prior art drill collars to bow or flex is increased.

The present invention provides a drill collar structure which is largely supported by the well fluid, and to thus provide a near weightless condition which effectively eliminates sag, produces far less flexure in response to end loading even though the material modulus is lower than with the heavier prior art drill collars.

Figure 3:
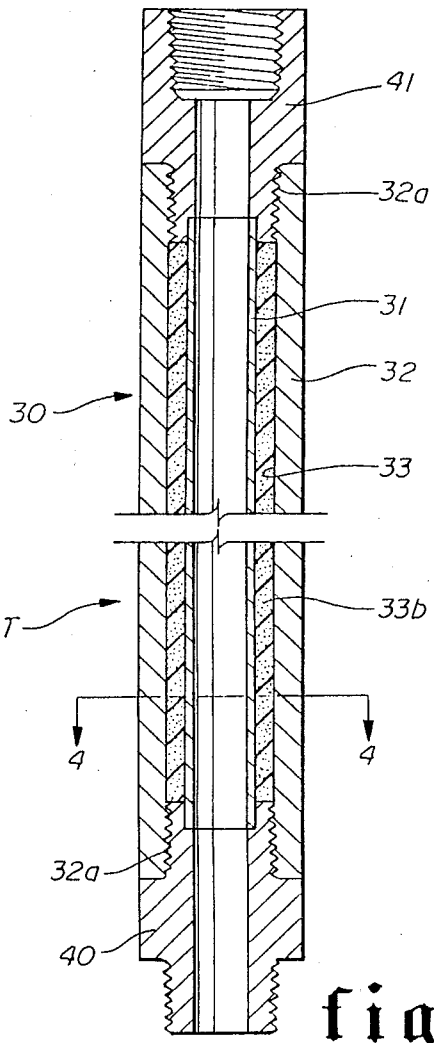
FIG. 3 is a longitudinal sectional view showing the completed tubular structure of the present invention.
Figure 2:
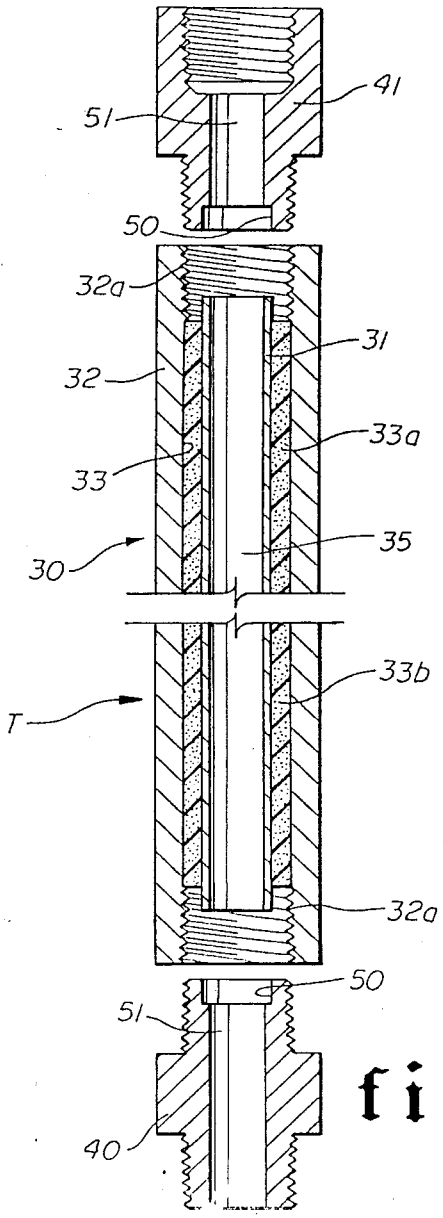
FIG. 2 is a sectional view similar to FIG. 1 with the filler plugs removed and the connection means ready to be engaged in position in the tubular means.
Figure 1:
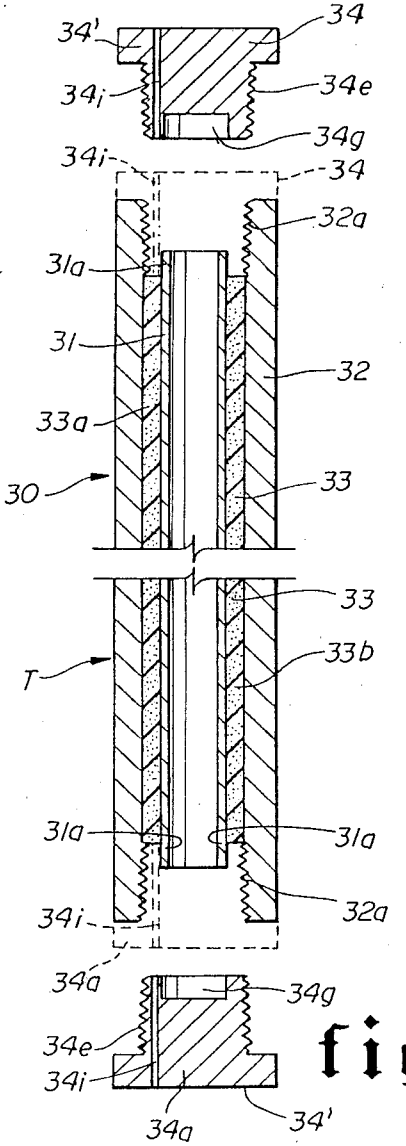
FIG. 1 is a longitudinal sectional view of the inner and outer tube means with rigid material in the annular space; filler caps are shown in dotted line in place during the filling operation of the annular space and the end caps or filler caps are illustrated in solid line.

Attention is now directed to FIGS. 1–3 of the drawings wherein a preferred embodiment of the present invention is illustrated. The tubular member of the present invention is there represented by the letter T and is intended for use in a drill string or well string to drill a deviated or horizontal well bore. The member includes an elongated tubular structure, represented by the numeral 30, formed by inner and outer tube means referred to generally at 31 and 32. The longitudinally extending inner and outer tube means 31, 32 are circumferentially spaced throughout their longitudinal extent to form an annular space or void 33 therebetween extending longitudinally thereof.

The annular space 33 is filled with rigid, solid material 33*a* to preclude relative movement between the inner and outer tubes 31, 32, and with the tubes 31, 32 forms the unitary longitudinally extending structure 30. The material or substance 33*a* functions to maintain the intended spaced relationship between the inner and outer tubes 31, 32 under all operating conditions; anchors the tubes 31, 32 together, thereby precluding relative motion and relative vibration therebetween; reinforces the inner and outer tubes 31, 32 against mechanical damage; and reduces stress on tubes 31, 32 due to hydrostatic downhole pressure tending to collapse the external tube 32 and burst the internal tube 31. The rigid material may be any suitable substance to accomplish the above intended functions and which will also not significantly affect the weight, stiffness or magnetic permeability properties of the drill collar of the present invention.

By way of example only, the material 33*a* may be a cellular, foamed plastic or a polymide type high temperature rigid plastic with or without filler such as expanded mineral granules—including Perlite and Vermiculite—or sintered bauxite or any other particulate material so long as the material along with the tubes 31, 32 forms a unitary structure having a specific gravity within the range noted herein. More specifically, the specific gravity range of the tubular structure 30 comprising the tubes 31, 32 and filler material 33*a* therebetween should not be greater than about three times that of water to attain the objects of the present invention. This range enables the wall thickness of tubes 31, 32 to be varied and enables the type of filler to be varied so long as the specific gravity of the resulting composite tubular structure 30 remains not greater than about three times that of water. The particulate material may be used without plastic binder and in such event will be sufficiently compacted in the space 33 to provide a substantially rigid, solid filler or which will act like a rigid filler in space 33 to anchor tubes 31, 32 together with the filler material to prevent relative movement or vibration between the tubes 31, 32.

In FIGS. 1–3, the material 33*a* is shown as being any suitable plastic with filler of any suitable type described dispersed therein as represented at 33*b*. To form the tubular structure shown in FIGS. 1–3, tubes 31 and 32 are engaged at their ends with plugs 34 and 34*a* and shown in dotted line in FIG. 1. The plugs 34 and 34*a* are provided with threads 34*e* to engage respectively with threads 32*a* in each end of the outer member 32 as shown in FIG. 1. The ends 31*a* of inner tube 31 are telescopically received in the inner ends 34*g* of each of the plugs 34, 34*a* as also shown in FIG. 1. Openings or passages 34*i* in each plug 34, 34*a* are provided for filling the space 33 and bleeding or venting the space 33 as necessary during filling with the material including the binder, when used, and the particulate filler or matter. The plugs 34, 34*a* each have an annular portion 34' which provides a shoulder to abut and seal with the ends of each outer member. Suitable releasing agent will be provided on the plugs 34, 34*a* to enable them to be removed after the filler material 33*a* has hardened.

Thereafter, the connectors may be threaded into each end of the outer tube means 32 to form the completed drill collar structure shown in FIG. 3. It will be noted that the inner tube 31 is telescopically received and preferably abutted in the central annular recess 50 at one end of passage 51 in each of the connectors 40, 41 to provide stability to the structure, although in some situations abutting may not be necessary. The passage 51 in each connector aligns with the passage 35 in inner member 31 as shown in the drawings. It should be understood to those skilled in the art that the tool joints 40 and 41 will preferably be formed of material having at least a much harder exterior surface so as to withstand the wear and tear of connecting and disconnecting by tongs or other devices normally employed during drilling operations. The resulting structure shown in FIG. 3 is ready for connection along with similar structures in a drill string to drill a deviated or horizontal well bore. The longitudinally extending bore 35 within the tubular drill collar structure 30 is formed by passages 51 and 35 and communicates drill fluid therethrough and to the drilling bit 12 at the lower end of the drill string, represented by the numeral 12 in FIG. 5, which will be referred to in greater detail hereinafter.

The tubular structure 30, represented in FIG. 1, is constructed of material and in a manner to displace at least about one-third its weight in water with the combined moments of inertia of the outer and inner tube means 31, 32, not exceeding about 80% of a solid wall tube that has substantially the same inner and outer diameter as a tubular structure T as illustrated in FIG. 3.

The preferred range of the combined moments of inertia of the outer and inner tube means 31 and 32 may be generally about 60% to about 70% of a solid wall tube having substantially the same inner and outer diameter as the tubular structure T, but the upper limit should not exceed about 80% of a solid wall tube of substantially the same inner and outer diameter as the tubular structure.

In addition to defining the elongated tubular structure 30 in terms of the combined moments of inertia of the inner and outer tube means 31, 32, it is also defined with reference to the modulus of elasticity of the material of construction. The modulus of elasticity of the inner and outer material of structure 30, as illustrated in FIG. 1 of the drawings, should not exceed about 20,000,000 pounds per square inch. The nature and characteristics of the filler material 33*a* will have no significant affect on the flexural qualities of the tubular structure. The structure of the present invention shown in FIG. 3 displaces at least about one-third its weight in water.

Preferably, the magnetic permeability of the tubular structure of this invention does not exceed that of air by more than about 10%. The term "magnetic permeability" as used herein is "relative permeability", i.e., permeability relative to air when subjected to the same magnetization force at the same temperature.

In lieu of defining the density of the mass comprising the tubular structure 30 of this invention in terms of the amount of water that it displaces, the mass might be defined in terms of weight wherein the weight of the tubular structure 30 in the drilling fluid in the well bore in which it is to be employed is not more than about 30% of the weight of a solid steel body having the same inner and outer diameter as that of a tubular structure 30 illustrated by FIG. 3.

For purposes of the present invention, the term "deviated well bore" as employed in relation to the advantages of the present invention applies to what is termed normal slant hole or directional drilling, as well as the drilling of well bores which approximate the horizontal.

Any suitable material, metallic or nonmetallic, within the parameters of the invention defined hereinabove may be employed for the tubes 31, 32. Some suitable metallic materials are aluminum alloys, titanium, magnesium and some of the bronzes, by way of example only. Some suitable nonmetals are Fiberglas, reinforced phenolic resins and the like. It can be appreciated that the filled annular space 33 may be large or small, but at any event, provides a structure within the critical range of parameters hereinbefore defined.

Generally speaking, over a range of conventional drill collar diameters (outside and inside) the moment of inertia of the tubular structure 30 will approximate about two-thirds that of conventional solid wall, heavy drill collars with the weight of the present invention being less than one-half. Aluminum hollow tubular structures constructed as illustrated in FIG. 3 of the present invention may, in comparison with heavy, solid wall drill collars of the same inner and outer diameter have only approximately 25% of the stiffness of such heavy, solid wall drill collars, weigh less than about 30% of the weight of such solid wall steel drill collar in typical drilling fluids and will float in the heavier drilling fluids. For example, drilling fluids may vary from water weighing 8.3 pounds per gallon at room temperature up to 17 or more pounds per gallon. The present invention, therefore, contemplates a drill collar constructed to approach or exceed buoyant conditions to accomplish the desired results. Heavy, solid wall drill collars will not float in any drilling fluid.

Figure 7:
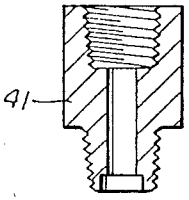
FIGS. 6 and 7 are each sectional views illustrating coupling or connecting means for connecting the drill collars of the present invention into a drill string.
Figure 6:
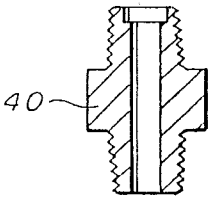

The foregoing definitions and parameters apply only to the basic tubular structure 30 shown in FIG. 2 and do not apply to the tool joints represented by the numerals 40 and 41 in FIGS. 6 and 7 employed for connecting the tubular structure 30 of FIG. 3 in the well or drill string.

The present invention reduces the stiffness and weight of drill collars employed in slant hole drilling far beyond that conceived possible prior to the present invention, and limitations now experienced with heavy, solid wall drill collars are overcome. With the tubular structure of the present invention illustrated in FIG. 3 constructed of material having an elastic modulus much less and in some cases only about one-third that of a heavy, solid wall collar, it can be appreciated that the rate limit of hole angle buildup may be increased up to approximately three times that heretofore possible or up to approximately 9° per 100 foot of well bore.

So called "pendulum" or "plumb bob effect" increases with increased hole angle. The tubular members of the present invention when employed in a drilling fluid having a high density, such as twelve pounds per gallon or greater, approach buoyancy or would actually be buoyant so they would float, thereby reducing or substantially, if not completely, eliminating pendulum effect heretofore encountered with prior art solid wall drill collars in deviated well bore drilling.

The present invention also eliminates the use of a near bit stabilizer in slant hole drilling and the reduction in drill collar weight and stiffness also makes possible maintenance of higher hole angles, thus greater bottom hole displacement in any directional drilling program.

For example, in FIG. 5 the slant hole or deviated well bore, accomplished by the present invention, is represented by the numeral 10*e*. The hole angle is illustrated at 16, being that angle between the axis 17 of the well bore 10*e* and vertical as represented by the line 18. To those skilled in the art, it will be seen that a substantial increase in the hole angle over and above that obtainable by the use of solid wall heavy drill collars and the near bit stabilizer arrangement of the prior art is possible with the present invention.

Further, the climb angle at the bottom of the well bore is again referred to by the numeral 21 and, as previously noted, is the angular relationship between the axis 17 of the well bore 10*e* and the axis 19 of the drill collar, represented at T′ in FIG. 5 of the present invention. With the device of the present invention, climb angle is less affected by hole angle than are devices used in present practice.

Contrary to what would be normally expected, the drill collars of this invention when employed in high angle, deviated well bores, bend less than conventional heavy wall drill collars of the prior art under the same end load conditions.

The present invention also enables the drilling of horizontal well bores to become practical which, heretofore, for all practical purposes have been difficult, if not substantially impossible, with conventional heavy solid wall drill collars employed by the prior art. Where the drill collar of the present invention is constructed to approach buoyancy in the drilling liquid employed in drilling the well bore (and if it were in a horizontal position), it more efficiently withstands substantially greater forces on both ends without buckling than a heavy, nonfloating solid wall member of the same diameter.

This invention also has application in the secondary and tertiary recovery of hydrocarbons from formations beneath the earth's surface in that it enbles deviated well bores to be drilled from the earth's surface and then continued at generally a horizontal relationship through a desired extent of a producing formation so as to subject more of it to various recovery steps well known to those skilled in the art.

The foregoing disclosure and description of the invention are illustrative and explanatory thereof, and various changes in the size, shape and materials, as well as in the details of the illustrated construction may be made without departing from the spirit of the invention.

What is claimed is:

1. A drill collar structure threaded at its ends for connection in a drill string to drill a deviated well bore comprising: longitudinally extending inner and outer tube means, said inner and outer tube means being circumferentially spaced substantially throughout their longitudinal extent to form an annular space therebetween, rigid filler material filling the annular space to form, with the inner and outer tube means, a unitary longitudinally extending tubular structure wherein said rigid filler material precludes movement of said inner and outer tube means relative to each other, said tubular structure having a specific gravity not greater than about three times that of water.

2. The drill collar structure of claim 1 wherein the magnetic permeability of said tubular structure does not exceed that of air by more than about 10%.

3. The drill collar structure of claim 1 wherein said unitary tubular structure displaces at least about one-third its weight in water with the combined moments of inertia of said inner and outer tube means being less than about 80% of a solid wall tube of substantially the same inner and outer diamter as said unitary tubular structure, the modulus of elasticity of the inner and outer tube means being less than about 20,000,000 pounds per square inch.

4. A drill collar structure for use in a rotary well string to drill a deviated well bore wherein a drill bit is connected to the lower end of the well string and a drilling fluid is circulated in the well bore during the drilling operations, the tubular member including:

a. an elongated unitary tubular structure having a longitudinal bore therethrough for circulating drilling fluid in the well bore, said unitary tubular structure including:

1. longitudinally extending inner and outer tube means connected together and circumferentially spaced substantially throughout their longitudinal extent to form a longitudinally extending annular space therebetween;

2. rigid filler material in the annular space to preclude movement of said inner and outer tube means relative to each other;

b. said inner tube having a longitudinal bore therethrough for circulation of the drilling fluid in the well bore; and c. threaded connector means for connecting the tubular structure in the well string, said threaded connector means having threads to threadedly engage said outer tube means at each of its ends, and abutting said inner tube means at each of its ends and said threaded connector means having additional threads to engage each end of the tubular structure in the well string.

5. The invention of claim 4 wherein said threaded connector means terminates adjacent said rigid filler material in the annular space to telescopically receive each end of the inner tube means.

6. The unitary tubular structure of claim 4 wherein its weight in the drilling fluid is less than about 30% of the weight of a solid steel body of the same inner and outer diameter as that of said unitary tubular structure and its moment of inertia is less than about 80% of a solid body of the same inner and outer diameter as that of said tubular structure.

7. The invention of claims 4, 5 or 6 wherein said tubular structure has a specific gravity not greater than about three times that of water.

8. A method of drilling a deviated well bore comprising the steps of:

securing adjacent a drill bit on the lower end of a drill string at least one tubular structure formed by spaced inner and outer tubes with rigid filler material therebetween to preclude relative movement between the inner and outer tubes, the structure having a longitudinal bore, displacing at least about one-third of its weight in water and having a moment of inertia not exceeding about 80% of a solid wall tube of substantially the same inner and outer diameter as the tubular structure;

circulating drilling fluid through the drill string and bore of the tubular structure to discharge through the drill bit; and rotating the drill string with the tubular structure therein while circulating the drilling fluid through the bore thereof to drill the deviated well bore.

9. A method of drilling a well bore with a hole angle above 15° comprising the steps of:

securing adjacent a drill bit on the lower end of a drill string at least one tubular structure formed by spaced inner and outer tubes with rigid filler material therebetween to preclude relative movement between the inner and outer tubes, the structure having a longitudinal bore, displacing at least about one-third of its weight in water and having a moment of inertia not exceeding about 80% of a solid wall tube of substantially the same inner and outer diameter as the tubular structure;

circulating through the drill string and bore of the tubular structure a drilling fluid the weight of which enables the tubular structure to at least approach buoyancy thereof; and rotating the drill string with the tubular structure therein while circulating the drilling fluid through the bore thereof to drill the deviated well bore.

10. A method of drilling a substantially horizontal well bore comprising the steps:

securing adjacent a drill bit on the lower end of a drill string at least one tubular structure formed by inner and outer longitudinally extending and radially spaced tube means to provide an annular space for receiving substantially rigid filler material therein to preclude relative movement between the inner and outer tube means with the specific gravity of the structure being not greater than about three times that of water;

circulating through the drill string, tubular structure and into the well bore a drilling fluid the weight of which enables the tubular structure to approach buoyancy therein; and rotating the drill string with the tubular structure therein while circulating fluid therethrough to drill the substantially horizontal well bore.

* * * * *